United States Patent [19]

Goodwin et al.

[11] Patent Number: 4,763,903

[45] Date of Patent: Aug. 16, 1988

[54] TARGET SCORING AND DISPLAY SYSTEM AND METHOD

[75] Inventors: Max W. Goodwin, Salina Star Rte., Boulder, Colo. 80303; Thomas T. Melsheimer, Longmont, Colo.

[73] Assignee: Max W. Goodwin, Golden, Colo.

[21] Appl. No.: 824,626

[22] Filed: Jan. 31, 1986

[51] Int. Cl.[4] ..... G01P 3/68

[52] U.S. Cl. ..... 273/371; 273/408; 250/553

[58] Field of Search ..... 273/371, 408, 378, 348, 273/26 A, 181 H; 250/222.1, 227, 553

[56] References Cited

U.S. PATENT DOCUMENTS

| | | | |
|---|---|---|---|
| 3,047,723 | 7/1962 | Knapp | 273/371 |
| 3,355,174 | 11/1967 | Hutson | 273/408 |
| 3,727,069 | 4/1973 | Crittenden, Jr. et al. | 273/371 |
| 4,150,825 | 4/1979 | Wilson | 273/181 H |
| 4,154,529 | 5/1979 | Dyott | 250/227 |
| 4,563,005 | 1/1986 | Hand et al. | 273/371 |

*Primary Examiner*—Maryann Lastova

*Attorney, Agent, or Firm*—Bruce G. Klass

[57] ABSTRACT

An automatic target shooting system for determining projectile location relative to a target, calculating a score based upon the location, and displaying a replica of the target with an indication of the location of the projectile relative to the target and the score. A target support structure defines a target area with criss-crossing X-Y-type coordinate light beams extending thereacross between light emitter devices and light receiving devices which generate output signals indicative of the location of a projectile during passage through the target area. The output signals are utilized by a computer device to identify the location of the projectile relative to the target, and to score the shot in accordance with the location. A replica of the target is displayed on a CRT screen with an indication of the location of the shot thereon and the score for the shot.

45 Claims, 6 Drawing Sheets

TARGET SCORING AND DISPLAY SYSTEM AND METHOD

This invention relates to the general field of target shooting and more particularly, to an automatic target scoring and display system.

There is a substantial amount of prior art relating to automatic target scoring and display systems. At least as early as Bergfeld U.S. Pat. No. 1,847,465, the use of electric circuits to indicate a projectile position on a target was given some consideration. Similarly, since at least as early as Hawkins U.S. Pat. No. 2,148,749, consideration has been given to apparatus for automatic target scoring. Kemmel et al. U.S. Pat. No. 2,592,429 discloses the use of mechanically operated impact responsive devices electrically wired to a score registering device located near the firing position. Klose U.S. Pat. No. 2,767,987 discloses an electro responsive target employing a series of conductor strips of thin material or foil arranged in spaced parallel relationship upon an insulating support associated with a common sheet metal or foil-like conductor.

Various kinds of target devices having impact actuated electrical circuits are disclosed in the prior art such as United States patents of Mauro U.S. Pat. No. 3,401,939, Mauro U.S. Pat. No. 3,454,277, Thalmann U.S. Pat. No. 3,529,828, Schary U.S. Pat. No. 3,580,579, Dalzell, Jr. U.S. Pat. No. 3,585,497, Knippel U.S. Pat. No. 3,602,510, Oatiler U.S. Pat. No. 3,677,546, Thalmann U.S. Pat. No. 3,705,725 and LaMura U.S. Pat. No. 4,240,640.

The prior art also includes non-impact systems, such as disclosed by the United States patents of Knapp U.S. Pat. No. 3,047,723, Ulrich U.S. Pat. No. 3,097,303, Hyman U.S. Pat. No. 3,475,029, Stoller U.S. Pat. No. 3,624,401, Finch U.S. Pat. No. 3,807,858, and in Filippini U.S. Pat. No. 4,204,683.

Prior art photoelectric-type systems, such as disclosed in Knapp U.S. Pat. No. 3,047,233 and Crittenclen, Jr. U.S. Pat. No. 3,727,069, have required the use of a variety of costly and easily damaged devices such as focusing lenses, slit masks, diaphragms and baffles for controlling the light. Such devices also required elaborate mounting apparatus as well as elaborate alignment and adjustment features. Also, the location detection apparatus has been costly and overcomplicated. Consequently, such prior art systems have been too costly, too unreliable, and/or too inaccurate to meet the requirements of competitive target shooting.

A primary object of the present invention is to provide a non-impact type highly accurate and reliable relatively low cost target system which is electronically operable by interruption of a multiplicity of closely spaced light paths arranged to criss-cross a target area defined by a standard removable and replaceable paper target sheet or the like. Another object is to provide an electronic system which is capable of scoring each shot in a series of shots and providing a cummulative scorew for a series of shots. Another object is to provide associated computer means for automatically recording scores for each of a plurality of shooters for computing the ranking of the shooters and for displaying various information on CRT display means or the like.

In general, the invention comprises a series of light emission means for providing closely spaced finite parallel criss-crossing discrete light beams located on X-Y axes on two sides of a target area and a corresponding series of closely spaced light response signal generating means located on opposite sides of the target area for generating signals indicative of interruption of the light beams during passage of a projectile therethrough. The light beams create a criss-cross grid means having a uniform spacing between light beams of sufficiently small size to cause interruption of at least two transversely extending light beams along each axis whenever a projectile passes through the target area. The coordinates of the interrupted light beams provide a highly accurate indication of the location of the projectile when it passes through the target area. Thus, variations in the signals generated by the corresponding light responsive signal generating means due to interruption by the projectile are indicative of the exact location of the projectile as it passes through the target area. The variations in these signals are used in connection with a computer means to record the location, assign an appropriate score for a shot, allocate the score to a particular shooter, total the score of a series of shots by a particular shooter and enable the score for any one shot and the total score for a series to be displayed on a CRT device.

BRIEF DESCRIPTION OF THE DRAWINGS

An illustrative and presently preferred embodiment is shown on the accompanying drawings which.

DETAILED DESCRIPTION OF THE INVENTION

Figure 1:
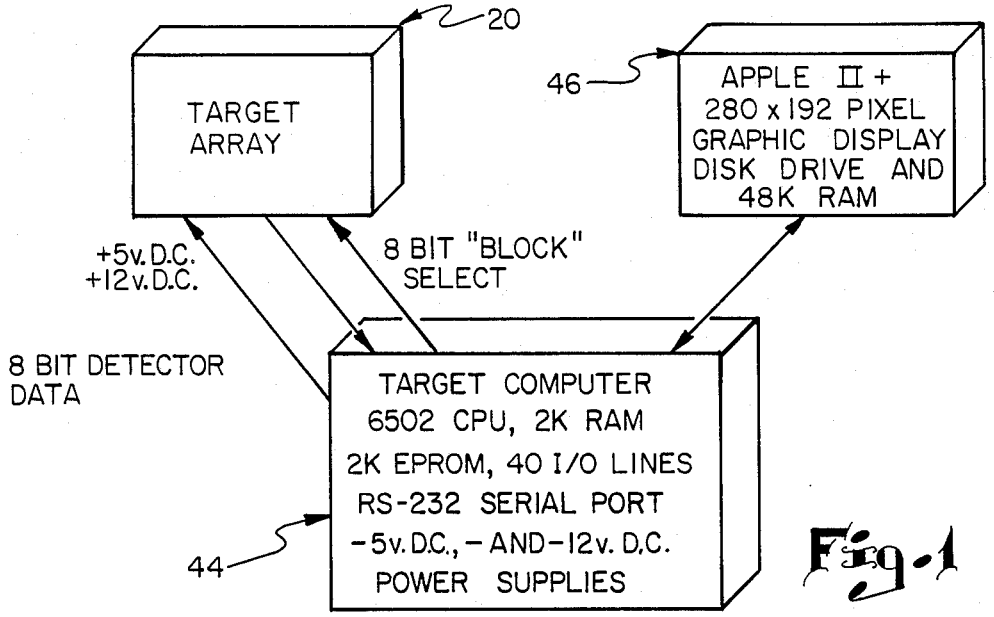
FIG. 1 is a schematic block diagram of the system components.
Figure 2:
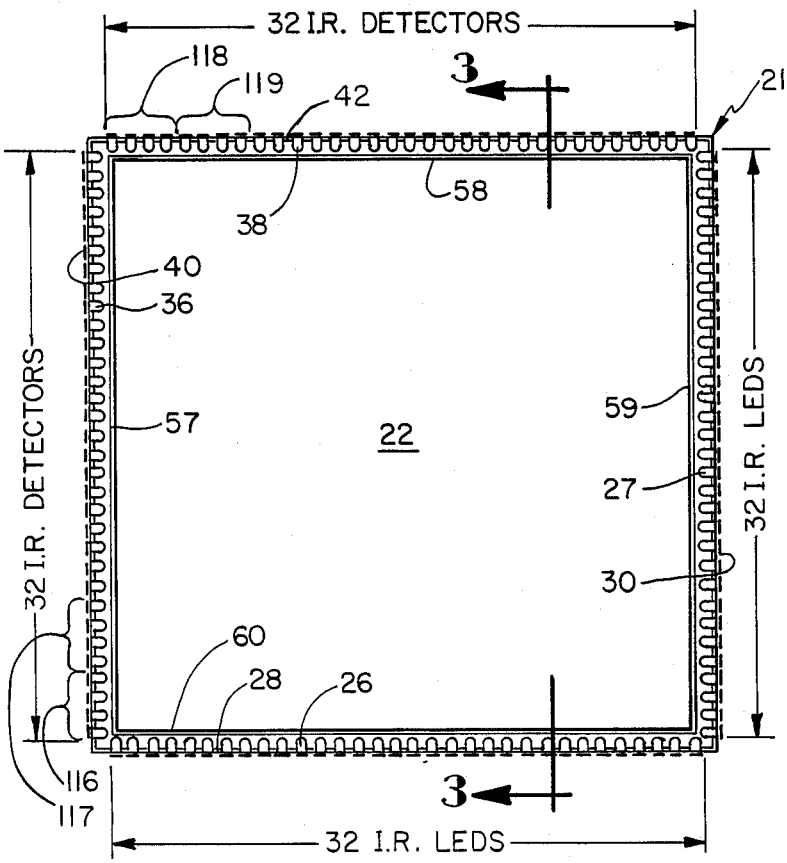
FIG. 2 is a side elevational view of the projectile location sensing means.
Figure 4:
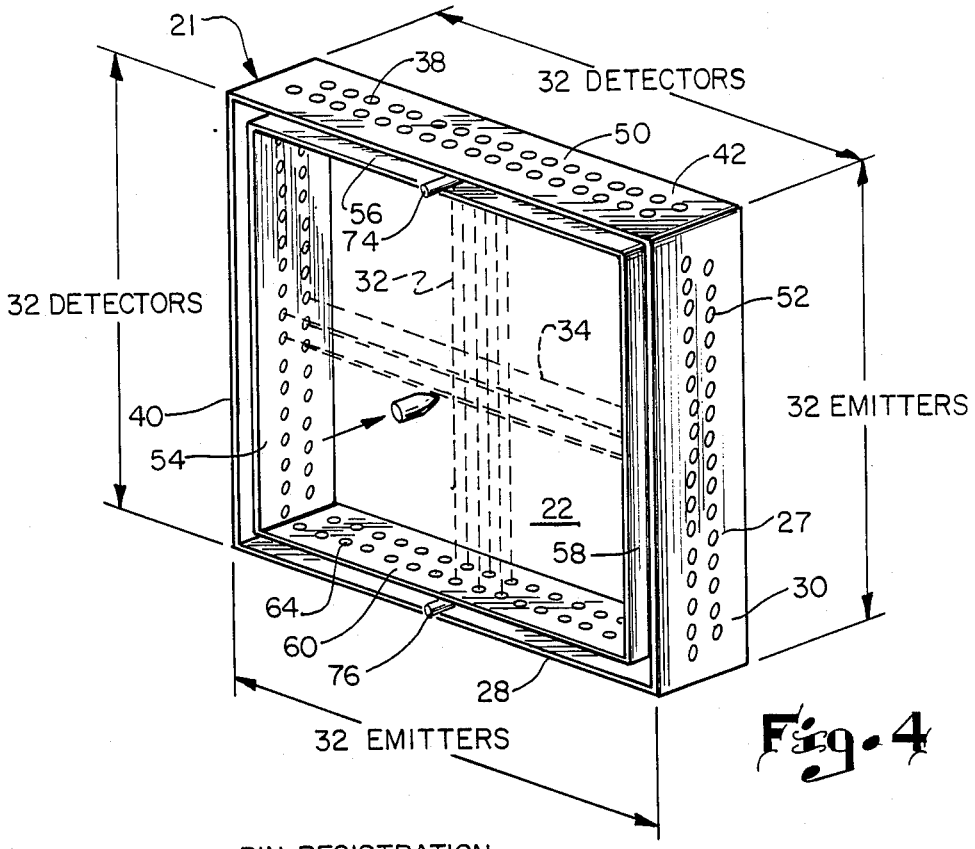
FIG. 4 is a perspective view of the projectile sensing means.
Figure 5:
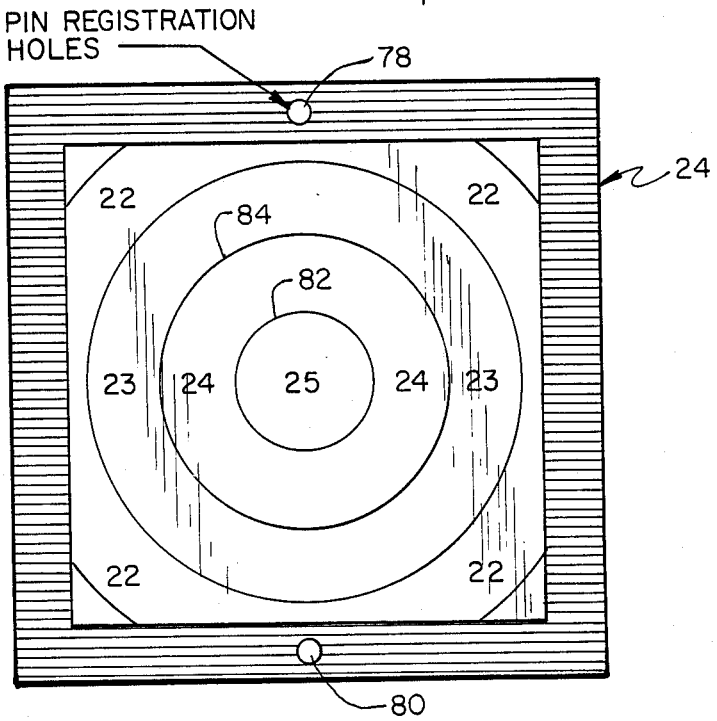
FIG. 5 is a front elevational view of a typical paper target.

In general, the system of the present invention comprises target array and projectile path sensing means 20 having a polygonal target support means 21, FIG. 2, for providing a polygonal open target area 22 and for supporting a paper target sheet 24, FIG. 5, across the target area. A plurality of light emitting means 26, 27, FIG. 2, are mounted on a first pair of transversely extending side wall portions 28, 30 of the target support means for providing a plurality of closely spaced finite collimated discrete light beams 32, 34, FIG. 4, extending laterally across the target area. A plurality of light responsive signal generating means 36, 38, FIG. 2, are mounted on a second pair of transversely extending side wall portions 40, 42 for normally generating a first signal indicative of non-interruption of the associated light beams. Each light generating means (emitter devices) is paired with one of the light responsive signal generating means (receiver devices) which is located directly opposite the associated one of the light generating means. The light generating means and the light responsive signal generating means comprise a plurality of commercially available infrared light emitting devices and detecting devices such as, for example, a Siemens SFH-309 silicon phototransistor-type device having a photo current of lmA and a wave length of maximum sensitivity of 850 nm; and a Siemens SFH-409 infrared emitter device having a radiant intensity in the axial direction of 7 (≧5) mW/sr and a wave length at peak emission of 950 nm which are available in a 3 mm plastic case. The devices are arranged in identical closely spaced relationship to provide an array of closely spaced non-visible limited wave length light beams extending across the target area in a manner such as to cause at least two transversely extending light beams to be interrupted by passage of a projectile through the target area. The light beams are not modified by lenses and extend directly through the air from the emitter devices to the detecting devices without passing through any light modifying device, such as a lense, but the divergent peripheral rays of light may be restricted so that the light received by the detector devices is primarily located within a cylindrical light path. Interruption of any light beam will cause a variation in the normal signal generated by the associated light responsive signal generating means and generation of a variation signal indicative of passage of the projectile through the associated light beam. Since the light beams are arranged to provide an X-Y coordinate-type grid system, a pair of variation signals from one each of the X and Y coordinate light-responsive signal generating means establishes the X-Y coordinate location of passage of the projectile. A target computer means 44, which may be a conventional, commercially available CPU device with suitable programming, is connected to and processes the signals generated by the light responsive signal generating means. The computer means is connected to a CRT-type graphic display means 46, which may be a conventional, commercially available Apple II device, with a disk drive and suitable memory capability which is programmed to provide a graphic display of the target area, the locations of projectile hits in the target area and scores for each hit and each series of hits by any particular shooter. Thus, the target array projectile path sensing means 20 is located in the target area of a firing range while the computer means 44 and the display means 46 may be remotely located in the firing area to provide instantaneous information to the shooters in the firing area. The computer means 44 and display means may be combined as one device.

Figure 3:
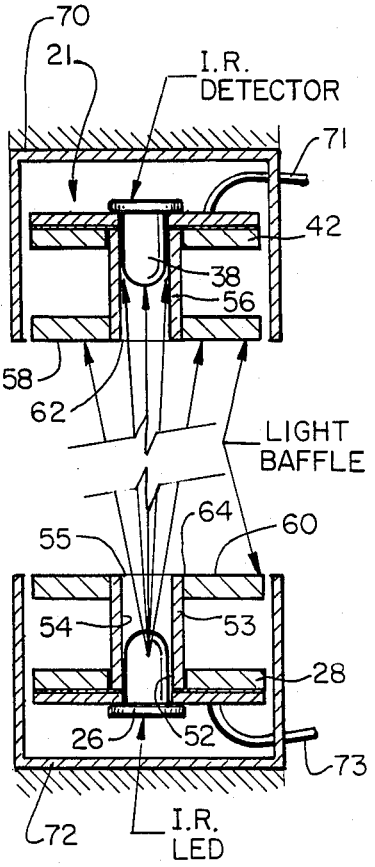
FIG. 3 is a cross-sectional view of a portion of the projectile location sensing means.

As shown in FIGS. 2–3, the side wall portions 28, 30, 40 and 42 of target array may be made from metallic plate material such as aluminum which are accurately secured to one another in any suitable manner such as by welding to provide a rigid, parallelogram frame with adjacent side wall portions extending at a right angle to one another and with opposite side wall portions being parallel to one another.

Figure 10:
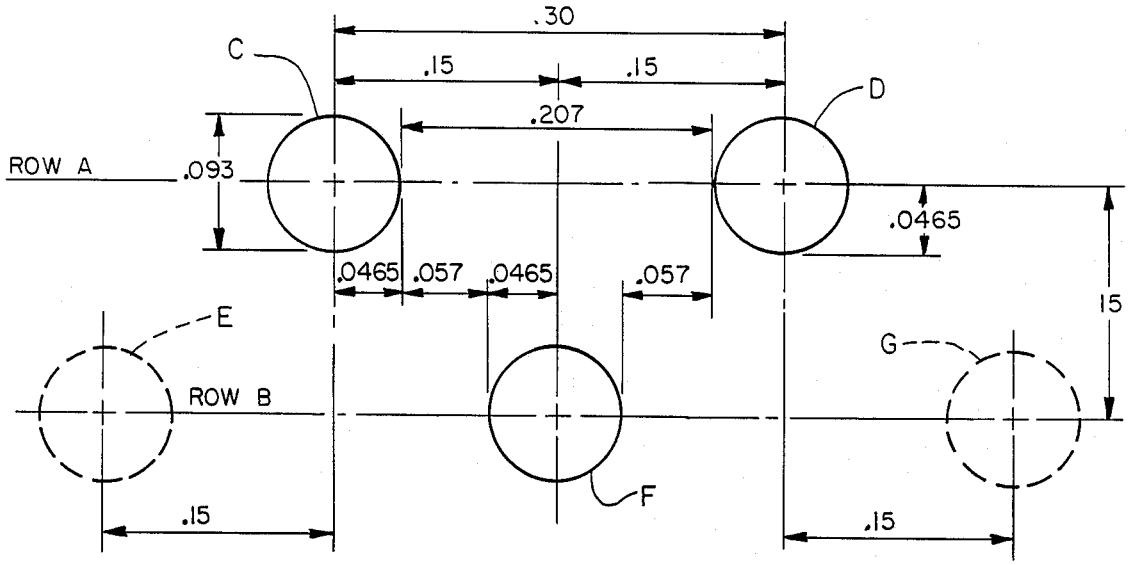
FIG. 10 is a schematic view of the arrangement of the light emitter devices, light receiver devices and light beams on one axis.

A plurality of spaced mounting holes 50, 52, FIG. 3, are precisely located on each side wall portion by a drilling or boring operation using a fixture to assure exact positioning and parallelism of the holes in each side wall portion as well as exact coaxial alignment with corresponding holes in the opposite side wall portion. The holes may be arranged in a single row or in a plurality of rows as illustrated in FIGS. 4 and 10. The holes in each row are spaced equidistant from one another and, if more than one row of holes is provided, the centers of the holes in each row are staggered relative to the centers of the holes in adjacent rows so as to increase the density of the light beam pattern. Commerically available infrared light emitting devices (I.R. LED) 26 are fixedly mounted in the holes 52 and commercially available infrared light detector and signal generating devices 38 are fixedly mounted in holes 50 so that each light emitting device has a corresponding associated light detector device located across the target area in coaxial parallel alignment with one another. Other kinds of light emitting devices and light detector devices may be utilized including laser and fibre optic devices.

In the illustrative embodiment of FIGS. 2–4 and 10, the target area has a size of approximately 4.65 inch×4.65 inch with 32 light emitting devices and 32 light detecting devices being employed on each side wall portion, but the target area may be of any suitable size. The diameters of the holes and devices is approximately 0.093 inch. The spacing between centers of adjacent holes and devices in each of the two rows in each side wall portion is approximately 0.30 inch, the spacing between centers of longitudinally adjacent staggered holes and devices from row to row is approximately 0.15 inch, and the lateral spacing between rows is 0.15 inch so that substantially the entire target area will be crossed by closely spaced light beams having a diameter substantially less than the diameter of any projectile to be fired through the target area. The preferred construction and arrangement is such that any projectile will intersect at least two adjacent light beams even if the projectile is centered on one light beam. For example, a 0.22 caliber projectile centered on one hole of 0.093 diameter would completely intersect one beam of light while also equally partially intersecting the two next adjacent beams of light.

For example, FIG. 10 shows a longitudinal row A of emitters and a laterally offset longitudinal row B of emitters. The centers of the adjacent emitters C, D, E, F, G etc. in each row are longitudinally offset from one another by 0.30 inch. The centers of the emitters E, F, G in row B are also laterally and longitudinally offset from the centers of the emitters A, B in row A by 0.15 inch. The diameters of the emitters is 0.093 inch. The longitudinal distance between the periphery of adjacent emitters, e.g., C, D, in each row is 0.207 inch. The longitudinal distance between the periphery of each of the emitters in one row and the periphery of emitters in the other row is 0.057 inch. Thus, a 0.22 caliber projectile, for example, will intersect at least two adjacent light beams CF or RD and may intersect as many as three liht beams CDF. In the illustrative embodiment of FIGS. 2–4, all devices A–G, etc. on the two intersecting wall portions 28 and 30 are emitter devices and the corresponding aligned devices on opposite intersecting wall portions 40, 42 are all receiver devices. In another embodiment, the devices C, D, etc. in one row A on each wall portion may all be emitter devices and the devices E, F, G etc. in the other row B may all be receiver devices with a corresponding reverse pattern on the opposite wall portions. In this manner, any problems associated with collimation of the light beams may be more easily resolved. Additional rows of emitter and receiver devices or only a single row of devices may be employed on each wall portion in some instances. The arrangement and pattern may be such that the X-Y axis light beams intersect one another in the target area or such that the X-Y axis light beams do not intersect one another.

Each light responsive signal generating device will generate a signal when the associated light beam is partially or totally intercepted by the projectile. The generated signals of adjacent light responsive signal generating devices are utilized to determine the location of the projectile during passage through the target area.

In order to provide a high degree of accuracy by producing substantially separate finite an discrete collimated light beams, a light collimating means in the form of an elongated cylindrical tubular member 53, FIG. 3, is associated with each of the light emitting devices 26 to provide a cylindrical light passage 54 having a cylindrical light discharge opening 55. The length of the tubular members 53 should be 30 to 35 times the diameter of the light passage 54 which is approximately the same diameter as the outside diameter of the light emitting device 26. Thus, the tubular members 53 in the illustrative embodiment, which have an inside diameter of approximately 0.12 inch, should have a length of between approximately 3.6 to 4.2 inches.

In addition, the inside wall of the tubular members should have a flat black color, substantially non-reflective surface. In the illustrative embodiment, the tubular members are made of aluminum material and the interior surface is coated with a flat black color by a paint dipping or anodizing process. Similar tubular members 56 are employed with the light receiver devices 38 to provide light baffle-collimating means. Tubular support means may be employed in the form of aluminum plate members 57, 58, 59, 60 having circular holes 62, 64 of a size and precisely arranged in a pattern corresponding to the pattern of holes 50, 52 and the associated emitter and receiver devices as shown in FIG. 10. Tubular members 53, 56 and plate members 57, 58, 59, 60 are suitably precisely rigidly mounted on side wall portions 28, 30, 40 & 42 of the target array. The circular holes 62, 64 and cylindrical tubular members 53, 56 provide substantially cylindrical light beam outlet means on the emitter sides of the target area and substantial cylindrical light beam inlet means on the receiver sides of the target area. Thus, the portions of the light beams crossing the target area between the plate members 57, 58, 59, 60 will have a generally circular cross-section and the portions of the light beams transmitted to the receiver devices will have a substantially cylindrical configuration.

Suitable bullet-proof shielding means 70, 72 are provided to protect the target array means and may be utilized to fixedly support the target array means in the target area of a firing range as illustrated in FIG. 3. The devices 26, 38 may be mounted in printed circuit boards and connected by suitable shielded cable means 71, 73 to a suitable power source and the computer means 44. Paper target positioning means, such as precisely located pin means 74, 76, FIG. 2, are mounted on the target frame means for cooperation with locating holes 78, 80 in the paper target 24 as shown in FIG. 5. The paper target has target indicia, such conventional concentric rings 82, 84, etc., which denote scoring areas having scoring values such as 22, 23, 24, 25.

Figure 6:
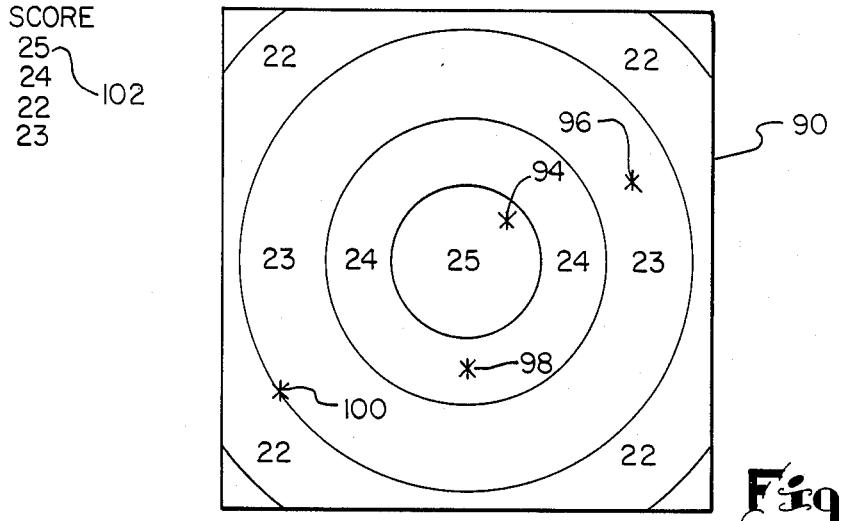
FIGS. 6–8 are representations of CRT displays of shots and scores.
Figure 7:
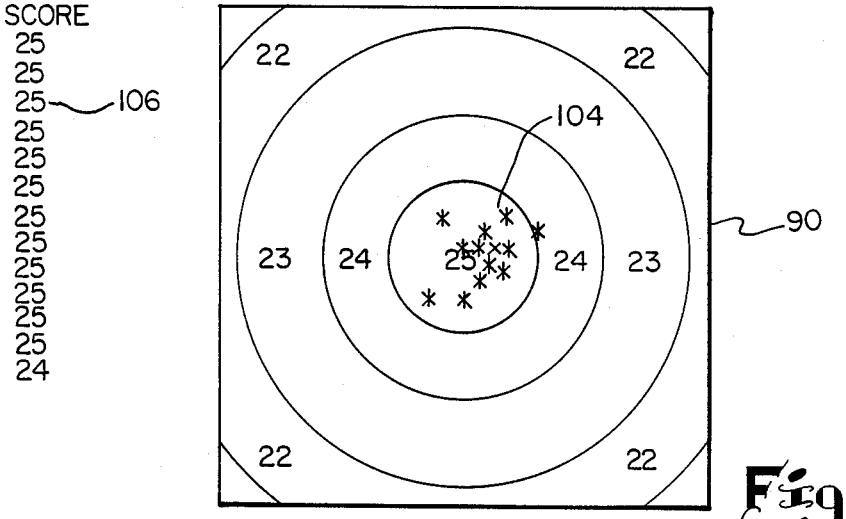
Figure 8:
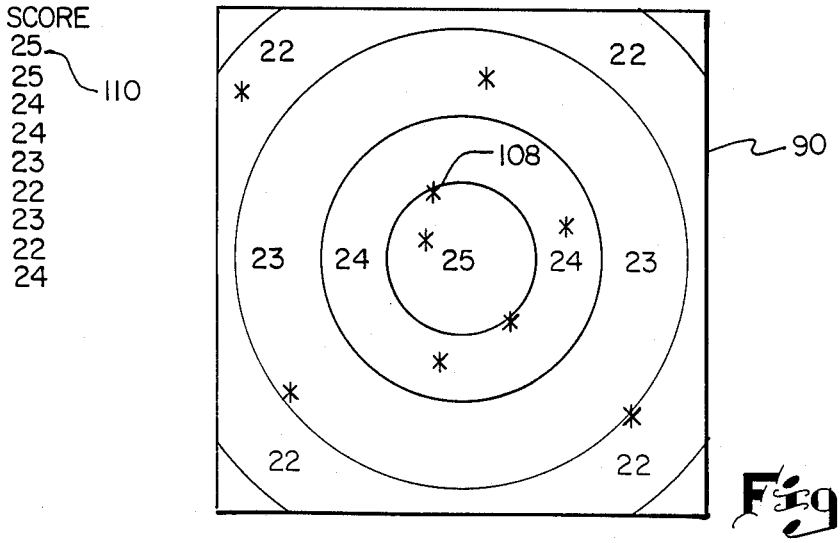

In general, target computer means 44 is programmed to identify the location of a projectile relative to the paper target by use of the variable signals generated by the light responsive devices, to assign an appropriate score for each shot, store the information and to transmit the information to the conventional, commercially available display means which is programmed to display a replica of the target 90 with shot location and score information as illustrated in FIGS. 6-8. FIG. 6 shows a display of four shots 94, 96, 98, 100 with corresponding scores 102. FIG. 7 illustrates a display of 13 shots 104 and corresponding scores 106. FIG. 8 illustrates a display of 9 shots 108 and corresponding scores 110. In addition, the scores may be automatically totalled and displayed along with any other information such as the name of the shooter.

Figure 9A:
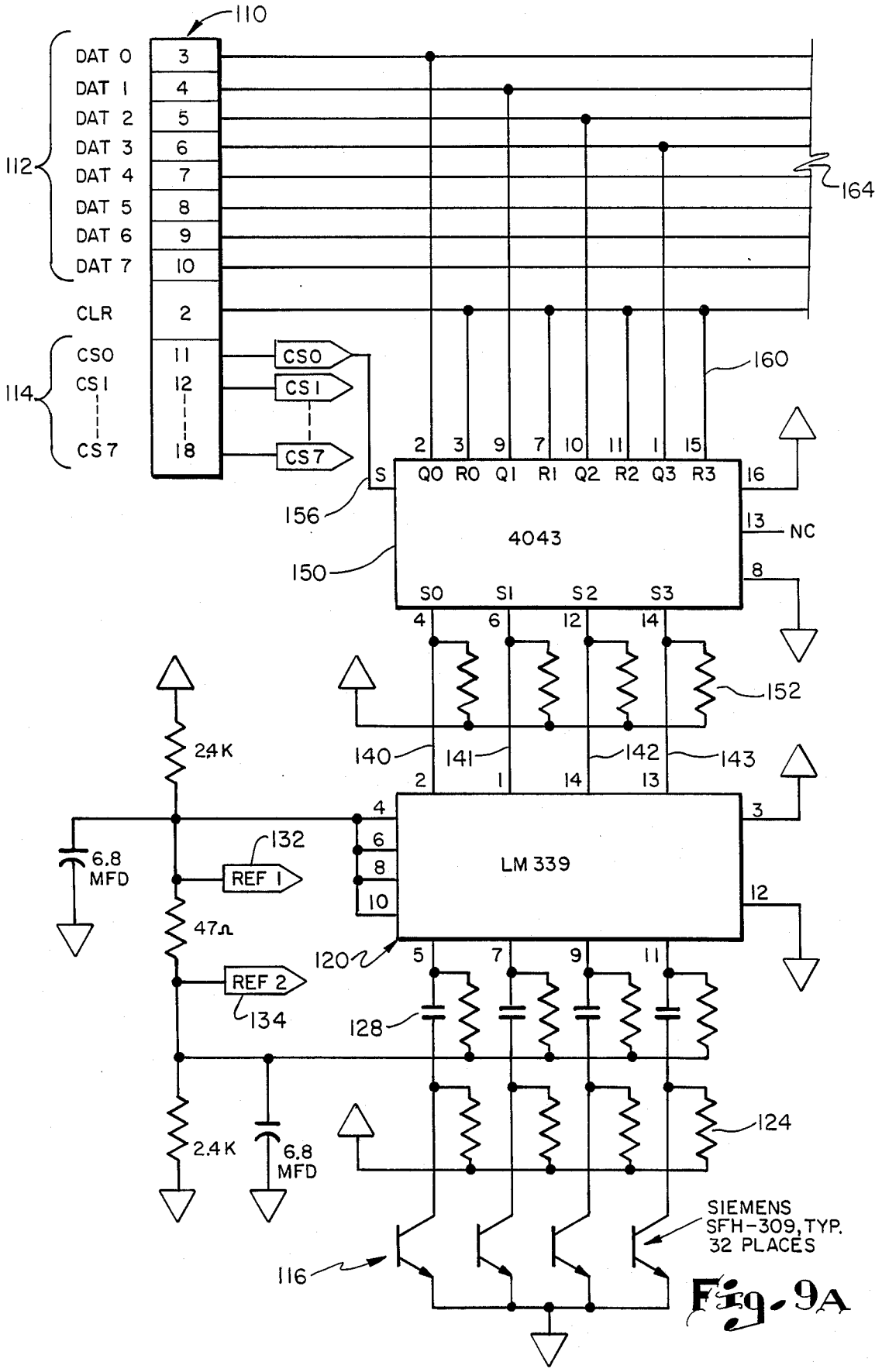
FIGS. 9A and 9B are a schematic drawing of the electronic components of the system.
Figure 9B:
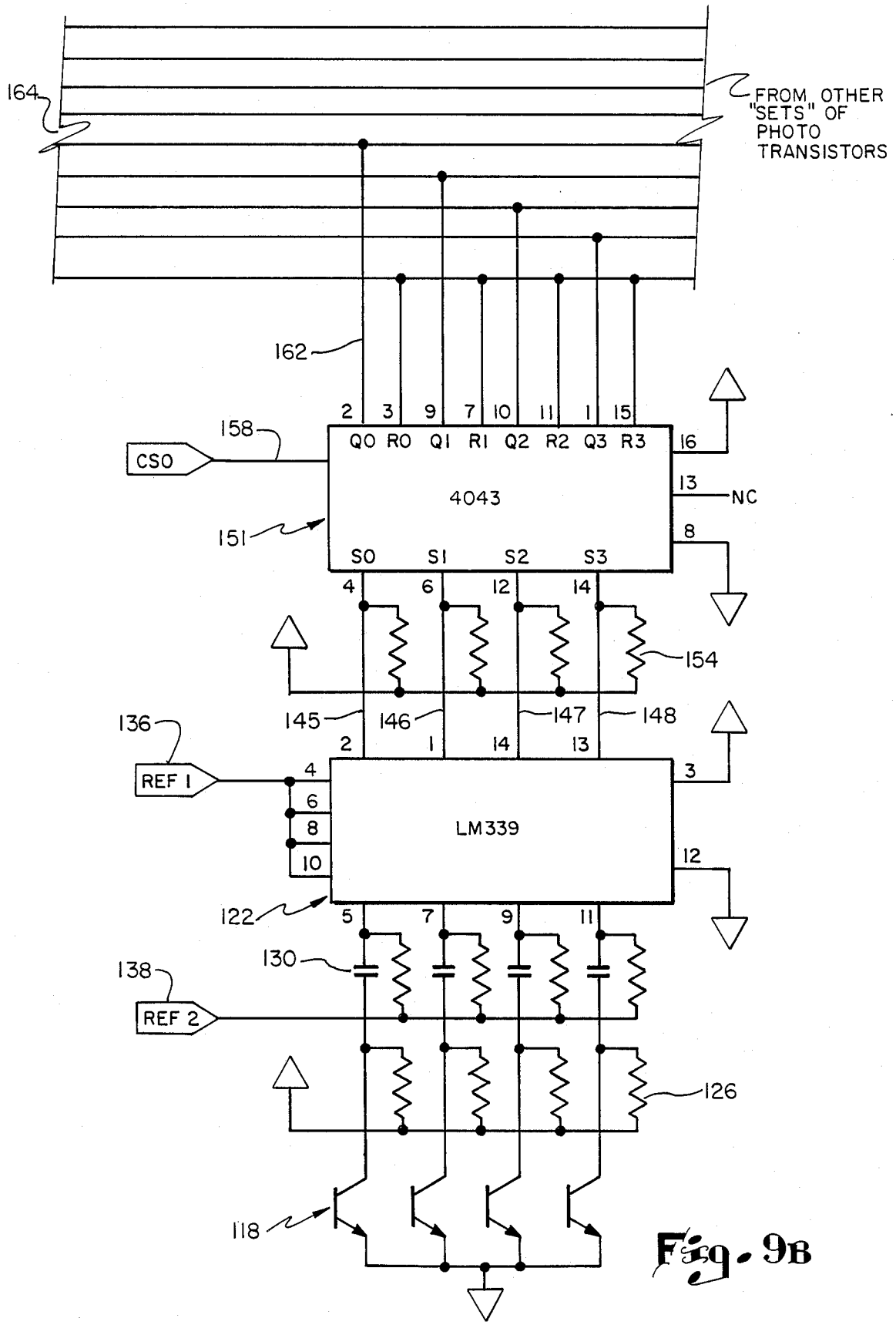

FIGS. 9A & 9B show the electronic devices and circuitry for coupling the signal generating means to the target computer means through an interface means 110 including an eight line search input signal portion 112 (CSO-7) and an eight line data output signal portion 114. The 32 signal generating means along each of the X and Y coordinate axes are divided into eight groups of four each as illustrated at 116, 117, 118, 119, FIGS. 2 and 9. Each group is connected to a conventional-type voltage comparator device 120, 122 (LM 339) etc. through resistors 124, 126 and capacitors 128, 130. When a projectile interrupts a light beam, a signal of 0.1 volts peak to peak is generated across the associated resistor. Reference voltages are supplied to the voltage comparator device in a conventional manner from reference voltage sources 132, 134, 136, 138 to determine the threshold voltage point of the voltage comparator device which has open output lines 140, 141, 142, 143, and 145, 146, 147, 148 connected to a conventional-type quadlatch device 150, 151 through pull-up resistors 152, 154. Thus, whenever a light beam is interrupted, an output signal indicative of interruption of that particular beam is provided on the output lines. Upon receipt of a signal CSO-7 on lines 156, 158, etc., the output signals are transmitted in a conventional manner from the quadlatch devices (4043) through output lines 160, 162, etc. to data lines 164 and data transfer terminal 112.

The construction and arrangement is such that a projectile may cause generation of one to four output signals from each latch device 150, 152, etc., depending upon the number of light responsive signal generating means in each group 116, 118, etc. which are actuated by partial or complete interruption of the associated light beam. Each output signal identifies a particular light beam and a particular location on the X or the Y coordinate axies. In the illustrative embodiment, the groups of light responsive signal generating means along one axis are serially searched and then the groups of light responsive signal generating means along the other axis are serially searched after each shot. The location of the shot on each X-Y axis is calculated in the computer means by determining the center position among the multiple output signals received during the search of each group of latch devices along each coordinate axis. For example, if three output signals are received from three adjacent light responsive signal generating means along the X coordinate axis, the location of the center one of the group of light responsive signal generating means is utilized to identify the location of the projectile on the X coordinate axis. If there are an even number of output signals received from four adjacent light responsive signals, the center of the group is utilized to identify the location of projectiles or the computer may be programmed to calculate the location as one-half the distance between the outermost opposite ones of the group of corresponding light beams. For most target shooting competitions, the foregoing arrangement provides more than sufficient accuracy and, as is conventional, the paper targets may be used to make any more specific determinations.

The system of the present invention provides target support means for supporting a target sheet with target indicia thereon across a target area; a plurality of separate closely spaced light emitting means located about the periphery of the target area for providing a multiplicity of separate individual generally parallel light beams of non-visible limited wave length of substantially circular cross-section extending across the target area and substantially covering the entire target area and being arranged in an X-Y coordinate pattern; target sheet mounting means for locating the target sheet on said target support means with the target indicia located in predetermined relationship with said X-Y coordinate pattern of light beams; a plurality of separate closely spaced light detector means equal in number to the number of the light emitting means located about the periphery of the target area opposite the light emitting means for normally receiving a generally cylindrical column of uninterrupted light from the light emitting means in the absence of the presence of a projectile in the target area and generating a normal standard signal indicative of uninterrupted receipt of light and for generating an interrupt signal upon passage of a projectile through the associated light beams in the target area; means for determining the location of each light beam interrupted by the passage of the projectile through the target area and for generating coordinate signals representative of the X coordinate and the Y coordinate of each interrupted light beam; means for receiving and correlating the coordinate signals to establish the precise location of the passage of the projectile through the target area and generate control signals representative of such locations; comparator means for comparing the control signals with scoring data based upon proximity of the precise location relative to the center of the target area or other reference position and providing a score signal representative of the score achieved; and means for displaying the score and for displaying a simulation of the target area and for displaying the location of projectile in the simulated target area.

The light emitting means are located on at least two emitter sides of the target area and the light receiving means are located on at least two other receiver sides of the target area opposite the two emitter sides to provide at least one row of closely spaced light beams extending along an X coordinate axis and at least one row of closely spaced light beams extending along a transverse Y coordinate axis. The light emitting means and the light receiving means are arranged in a pattern providing a space between adjacent ones thereof which is less than the diameter of the light emitting means, and are arranged in a pattern and have a diameter such that the projectile will interrupt more than one beam of light in each row along each of the X and Y coordinate axes. Light baffle collimating means are associated with the light emitting devices and light receiving devices for forming a generally cylindrical column of light therebetween.

The invention also provides a method of automatic electronic determination of location of passage of a projectile through a target area comprising providing a multiplicity of discrete separate light beams extending across the target area in a fixed X-Y coordinate pattern whereby a projectile passing through the target area will pass through at least one of the X coordinate light beams and at least one of the Y coordinate light beams transmitted across the target area; mounting a target sheet across the target area with target indicia on the target sheet located in predetermined relationship to the fixed X-Y coordinate pattern of light beams; generating a first set of electronic signals indicative of the amount of light normally transmitted across the target area by each of the light beams in the absence of the passage of a projectile through the target area and generating a second set of electronic signals when a projectile passes through the target area indicative of the light beams interrupted by the projectile; identifying the location of the light beams interrupted by the projectile during passage through the target area; calculating the location of the projectile during passage through the target area by the indentification and location of the light beams interrupted by the projectile during passage through the target area; and generating location signals representative of the location of the projectile during passage through the target area. The location signals may be transmitted to a display means including a representation of the target area and displaying the location of the passage of the projectile in association with the representation of the target area.

A score may be electronically based upon the location of the projectile during passage through the target area and score signals representative of the calculated score may be generated and transmitted to the display means for displaying the score with the display of the location of the projectile during passage through the target area.

The score information may be stored each time a projectile passes through the target area; the total score of successive projectiles may be calculated and total score signals may be transmitted to the display means for display of the total score with the representation of the target area.

Shooter identification information for each of a plurality of shooters may be stored in the system and projectile location information for each shot of each shooter may be correlated with the shooter information for each shooter.

The system also provides a method of determining the location of a projectile during passage through a target area comprising: arranging and mounting at least two transversely extending rows of light emitting devices on first and second sides of the target area so that one row of light emitting devices extends transversely to one other row of light emitting devices and arranging and mounting at least two rows of light responsive devices on transversely extending second and third sides of the target area so that one row of light responsive devices extends transversely relative to the other row of light responsive devices and one of the light responsive devices in each of light responsive devices row is in coaxial alignment with one of the light emitting devices in an opposite row of light emitting devices; generating a criss-crossing coordinated matrix of separate individual closely spaced light beams extending across the target area with at least one set of closely adjacent parallel light beams extending thereacross in a first direction and at least one other set of closely adjacent parallel light beams extending thereacross in a second direction transvese to the first direction so as to provide an X-Y type coordinate light beam pattern; mounting a target sheet across the target area with target indicia on the target sheet located in predetermined relationship to the fixed X-Y coordinate pattern of light beams; firing a projectile through the target sheet and the target area and interrupting at least one light beam in each set of X-Y coordinate light beams; and determining the location of the projectile during passage through the target sheet and the target area by measuring variations in the amount of light transmitted across the target area by each of the light beams.

A replica target sheet image is displayed on a display device at a location remote from the target area and shot location signals indicative of the location of the projectile during passage through the target sheet and the target area are utilized for displaying shot location images on the replica target sheet image on the display device.

It is intended that the appended claims be construed to include alternative embodiments of the invention except as precluded by the prior art.

What is claimed is:

1. A system for automatically determining the location of a relatively small size projectile, fired from a gun and travelling at relatively high velocity, relative to a target area and for scoring the proximity of the projectile to the center of the target, the system comprising:

a first rigid quadrilateral frame means having spaced parallel vertical side portions and spaced parallel upper and lower horizontal side portions for defining a polygonal open target area therebetween;

said frame means comprising a first pair of two first and two second transversely extending flat side wall plate members and a second pair of two third and two fourth transversely extending flat side wall plate members arranged in a generally polygonal configuration with opposite ones of each pair of said side wall plate members being located in spaced relationship on opposite sides of said target area and being parallel to one another with an inner peripheral side surface of one of said plate members of each pair of plate members facing inwardly toward the target area and an outer peripheral side surface of one of said side plate members of each pair of plate members facing outwardly away from the target area;

at least two transverse rows of a plurality of separate closely spaced light emitting means mounted on said frame means with a first row extending along a first one of said vertical side portions and a second row extending along a first one of said horizontal side portions along the periphery of the target area for providing a multiplicity of separate, individual, generally parallel light beams of non-visible limited wave length of substantially circular cross-section extending across the target area projected directly through the atmosphere without passage through any intervening separate device extending across the path of the light beam and substantially covering the entire target area and being arranged in an X-Y coordinate axis pattern;

target sheet mounting means mounting on said frame means for supporting and locating a target sheet with target indicia on said frame means with the target indicia located in predetermined relationship with said X-Y coordinate pattern of light beams;

at least two transverse rows of a plurality of separate closely spaced light detector means equal in number to the number of said light emitting means and being mounted on said frame means with one row extending along a second one of said vertical side portions and a second row extending along a second one of said horizontal side portions along the periphery of the target area opposite the light emitting means for normally directly receiving a generally cylindrical column of uninterrupted light directly through the atmosphere without passage through any intervening separate device extending across the path of the light beam from an associated one of the light emitting means in the absence of the presence of a projectile in the target area and for enabling each light detector means to generate a normal standard separate signal indicative of uninterrupted receipt of light from the associated light emitter means and to generate a separate interrupt signal upon passage of a projectile through the associated light beam in the target area;

said parallel light beams having a diameter of less than one-half the diameter of the projectile and said light emitting means and said light detector means in each row being mounted in closely spaced laterally adjacent relationship so that at least two of said parallel light beams are interrupted and at least two of said light detector means generate a separate interrupt signal during passage of a projectile through the target area;

means for receiving said interrupt signal from each of said light detector means and determining the location of each light beam interrupted by the passage of the projectile through the target area and for generating coordinate signals representative of the x coordinate and the Y coordinate of each interrupted light beam; and means for receiving and correlating the coordinate signals with prior established coordinate reference information to establish the precise location of the passage of the projectile through the target area and to generate control signals representative of such locations.

2. The invention as defined in claim 1 and further comprising:

comparator means for comparing the control signals with prior established scoring data information based upon proximity of the precise location relative to a reference point in the target area and providing a score signal representative of the score achieved.

3. The invention as defined in claim 2 and further comprising:

means for displaying the score and for displaying a simulation of the target area and for displaying the location of projectile in the simulated target area.

4. The invention as defined in claim 1 and wherein said light emitting means are infrared light generating devices and said light detector means are infrared light responsive device.

5. The invention as defined in claim 1 and wherein said light emitting means and said light detector means are laser devices coupled with fiber optical devices.

6. The invention as defined in claim 1 and further comprising:

tubular mounting means in said frame means for fixedly separately mounting each of said light emitting means and each of said light detector means with said light emitting means and said light detector means being arranged in said pattern in directly opposite relationship and having an uninterrupted passage with an open end portion therein for enabling projection of said light beams directly from each of said light emitting means to each of said light receiving means through the atmosphere without passage through any intervening device extending across the path of the light beams.

7. The invention as defined in claim 6 and wherein said tubular mounting means and said light emitting means and said light detector means are arranged in a pattern providing a laterally offset space therebetween which is less than the diameter of said parallel light beams generated by the light emitting means.

8. The invention as defined in claim 7 and wherein light emitting means and said light detector means having cylindrical peripheral surfaces and are mounted in one end of said tubular mounting means opposite said open end portion and are arranged in a pattern and have a diameter such that the projectile will interrupt more than one beam of light in each row along each of the X and Y coordinate axes.

9. The invention as defined in claim 8 and wherein there are at least two rows of light emitting devices and at least two rows of light detector devices on each side of the target area.

10. The invention as defined in claim 9 and wherein each row of the light emitting devices and the light detector devices on each side of the target area are laterally offset and the centers of the light emitting devices and the light detector devices in each row are laterally offset from the corresponding type devices in the other rows.

11. The invention as defined in claim 10 and further comprising:

light baffle means associated with said light emitting devices and said light detector devices for forming a generally cylindrical column of outlet light from the light emitting means and a generally cylindrical column of inlet light to said light detector means.

12. The invention as defined in claim 11 and wherein said light baffle means comprises laterally inwardly spaced plate devices having cylindrical holes therethrough located in closely spaced juxtaposition to each of the devices.

13. The invention as defined in claim 12 and wherein said light baffle means comprises cylindrical tubular devices mounted circumjacent each of said devices.

14. The invention as defined in claim 1 and wherein:

each of said light emitting means comprises only a separate generally cylindrical infrared light emitting device having a generally circular cross-section and each of said light detector means comprising only a separate generally cylindrical infrared light responsive device; and device mounting means for each row of said light emitting means and for each row of said light detector means comprising a plate member having a plurality of circular holes arranged in said pattern for receiving and supporting said light emitting and responsive devices in said pattern.

15. The invention as defined in claim 14 and wherein:

said device mounting means further comprises a plurality of tubular members each having an outside diameter approximately equal to the diameter of said holes and an inside diameter approximately equal to the outside diameter of said light emitting devices and said signal generating devices with one end of each tubular member mounted in each hole and receiving an associated device through the outside peripheral surface of the support plate member and having a light opening at the other end thereof for transmitting light into the target area and receiving light crossing the target area.

16. The invention as defined in claim 14 and wherein:

each plate member has a flat outermost peripheral surface facing away from the target area and a flat innermost peripheral surface facing toward the target area;

said circular holes in each plate member extending through said plate member between said outermost peripheral surface and said innermost peripheral surface; and said devices being mounted in said holes with an electrical lead end portion located adjacent the outermost peripheral surface and the light emitting and light receiving end portions thereof extending toward the innermost peripheral surface.

17. The invention as defined in claim 16 and wherein:

said device mounting means further comprises a cylindrical tubular member associated with each light emitting and responsive device and has an outside diameter approximately equal to the diameter of the holes and an inside diameter approximately equal to the outside diameter of said devices, one outermost end portion of said tubular member being fixedly mounted in each of said holes and one innermost end portion extending inwardly toward the target area and has an unobstructed opening located adjacent the target area, said devices being mounted in said innermost end portions or said tubular members with the lead end portions located adjacent the outermost peripheral surface and the light emitting and receiving portions located within said tubular member and facing said light.

18. The invention as defined in claim 1 and wherein:

said light emitting means comprises:

a plurality of separate individual self-contained generally cylindrical light emitting devices mounted on said first pair of first and second transversely extending flat side wall plate members; said light detector means comprises:

a plurality of separate self-contained generally cylindrical light responsive signal generating devices mounted on said second pair of third and fourth transversely extending flat side wall plate members.

19. The invention as defined in claim 18 and further comprising:

a plurality of equally spaced cylindrical mounting hole means being precisely located on each side wall plate member for each of said light emitting devices and each of said signal generating devices for exact positioning and parallelism of the devices in each side wall plate member as well as exact coaxial alignment of said light emitting devices with corresponding signal generating devices in the opposite side wall portion.

20. The invention as defined in claim 19 and wherein:

there are two parallel rows of offset staggered devices and two parallel rows of offset staggered mounting hole means in each side wall plate member;

the diameters of the holes and devices is approximately 0.093 inch, the spacing between centers of adjacent holes and devices in each of the two rows in each side wall portion is approximately 0.30 inch, the spacing between centers of longitudinally adjacent staggered holes and devices from row to row is approximately 0.15 inch, and the lateral spacing between rows is approximately 0.15 inch so that substantially the entire target area will be crossed by closely spaced light beams having a diameter substantially less than the diameter of any projectile to be fired through the target area.

21. The invention as defined in claim 19 and wherein: the construction and arrangement is such that any projectile will intersect at least two adjacent light beams even if the projectile is centered on one light beam.

22. The invention as defined in claim 21 and wherein each light responsive signal generating device generates a signal when the associated light beam is partially or totally intercepted by the projectile.

23. The invention as defined in claim 19 and further comprising:

light baffle and collimating means in the form of an elongated cylindrical tubular member associated with each of the light emitting devices for providing an uninterrupted cylindrical light passage having a cylindrical light discharge opening and generating substantially separate finite and discrete collimated light beams.

24. The invention as defined in claim 23 and wherein: the length of the tubular members is approximately 30 to 35 times the diameter of the light passage and the light passage is approximately the same diameter as the outside diameter of the light emitting device.

25. The invention as defined in claim 24 and wherein: the inside wall of the tubular members has a flat black color providing a substantially non-reflective surface.

26. The invention as defined in claim 25 and wherein said tubular members are employed with both of the light emitting devices and light receiver devices.

27. The invention as defined in claim 19 and wherein: the portions of the light beams crossing the target area between the plate members have a generally circular cross-section and the portions of the light beams transmitted to the signal generating devices have a substantially cylindrical configuration.

28. The invention as defined in claim 19 and including bullet-proof shielding means for protecting the target and for fixedly supporting the target in the target area of a firing range.

29. The invention as defined in claim 18 and wherein: each of said light emitting devices and said signal generating devices are mounted in printed circuit boards and connected by shielded cable means to a suitable power source and a computer means.

30. The invention as defined in claim 18 and further comprising:

paper target positioning means in the form of locating pin means mounted on the target frame means for cooperation with locating holes in the target sheet.

31. The invention as defined in claims 1 or 18 and further comprising:

electronic device and circuitry means for coupling the signal generating means to a target computer means through an interface means including an eight line search input signal portion and an eight line data output signal portion.

32. The invention as defined in claim 31 and wherein: the signal generating means along each of the X and Y coordinate axes are divided into eight groups of four each and each group is connected to a voltage comparator device.

33. The invention as defined in claim 32 and further comprising:

a plurality of quadlatch means having associated resistor means for receiving said interrupt signals when a projectile interrupts a light beam and for generating a voltage signal across the associated resistor means for comparison with reference voltages supplied to the voltage comparator device from reference voltage sources to determine the threshold voltage point of the voltage comparator device which has open output lines connected to the quadlatch means through pull-up resistors so that whenever a light beam is interrupted, an output signal indicative of interruption of that particular beam is provided on the output lines and upon receipt of a signal, and the output signals are transmitted from the quadlatch means through output lines to data lines and a data transfer terminal.

34. The invention as defined in claim 33 and wherein: the construction and arrangement is such that a projectile causes generation of one to four output signals from each latch means depending upon the number of light responsive signal generating means in each group which are actuated by partial or complete interruption of the associated light beam, and each output signal identifies a particular light beam and a particular location on the X or the Y coordinate axes.

35. The invention as defined in claim 34 and wherein: the groups of light responsive signal generating means along one axis are serially searched and then the groups of light responsive signal generating means along the other axis are serially searched after each shot and the location of the shot on each X—Y axis if calculated in the computer means by determining the center position among the multiple output signals received during the search of each group of latch means along each coordinate axis.

36. The invention as defined in claim 18 and wherein: said plate members have outer peripheral flat surfaces facing away from the target area and inner peripheral flat surfaces facing toward the target area;

each plate member has at least one row of parallel closely spaced circular passages of equal diameter extending through the plate member between the flat outer peripheral surface and the flat inner peripheral surface and the diameter of the circular passages being approximately equal to the diameter of said emitting and responsive devices;

elongated tubular means fixedly mounted in each of said circular passages and extending inwardly a substantial distance therefrom toward the target area for providing a cylindrical light passage having a cylindrical opening at the innermost end portion thereof facing inwardly toward the target area, each elongated tubular means comprising an elongated cylindrical tubular member having a cylindrical passage of approximately the same diameter as the emitting and signal generating devices and having an outer end portion fixedly mounted in one of said circular passages and an inner end portion spaced inwardly from said plate member;

one of each of said emitting an signal generating devices being mounted within one of said cylindrical passages in said outer end portion of an associated one of said tubular members with the lead end of the devices facing outwardly and the light transmitting end portion and the light receiving end portion of each emitting and signal generating device facing inwardly toward said light opening in said tubular member and being located in concentric relationship with a cylindrical passage; and printed circuit board means mounted along said outwardly facing flat side surface of each of said plate members and being connected to each of the emitting and signal generating devices therealong for energizing said emitting and signal generating devices and transmitting output signals therefrom.

37. The invention as defined in claim 36 and further comprising:

a second rigid parallelogram support frame means for supporting said tubular members comprising additional plate members having a corresponding second row of circular passages therein, the inner end portion of each of said tubular members along each row being mounted in a corresponding one of said second row of circular passages in said additional support plate members, the outside diameter of said inner end portion of each of said tubular members being substantially equal to the diameter of the associated second circular passage in said additional support plate member to enable said inner end portion to be received therewithin.

38. The invention as defined in claim 37 and further comprising:

a rigid bulletproof outermost frame means providing a space therewithin for receiving and protecting said first frame means and said second frame means from impact by projectiles, said bulletproof frame means comprising channel-shape plate means having spaced parallel side wall portions connected by a transverse wall portion and defining an elongated channel therewith and an inwardmost elongated opening facing toward the target area.

39. A method of automatic electronic determination of location of passage of a relatively small size relatively high velocity projectile through a target area comprising:

arranging a multiplicity of single separate unitary individual light generating devices in a fixed X-Y coordinate pattern around the target area and generating a multiplicity of discrete separate light beams extending across the target area in a fixed X-Y coordinate pattern whereby a projectile passing through the target area will pass through at least two of the X coordinate light beams and at least two of the Y coordinate light beams transmitted across the target area;

mounting a target sheet across the target area with target indicia on the target sheet located in predetermined relationship to the fixed X-Y coordinate pattern of light beams;

arranging a multiplicity of single separate unitary individual light sensing and signal generating devices in the fixed X-Y coordinate pattern with only one of the light sensing and signal generating devices being located in coaxial parallel relationship with only one of the light generating devices and generating a first set of electronic signals indicative of the amount of light normally transmitted across the target area by each of the light beams in the absence of the passage of a projectile through the target area and generating a second set of electronic signals when a projectile passes through the target area indicative of each of the light beams interrupted by the projectile;

identifying the location of each of the light beams interrupted by the projectile during passage through the target area by use of each of the second set of electronic signals;

calculating the location of the projectile during passage through the target area by the identification and location of each of the light beams interrupted by the projectile during passage through the target area; and generating location signals representative of the location of the projectile during passage through the target area.

40. The method as defined in claim 30 and further comprising:

transmitting the location signals to a display means including a representation of the target area and displaying the location of the passage of the projectile in association with the representation of the target area.

41. The method as defined in claim 40 and further comprising:

electronically calculating a score base upon the location of the projectile during passage through the target area;

generating score signals representative of the calculated score;

transmitting the score signals to the display means and displaying the score with the display of the location of the projectile during passage through the target area.

42. The method as defined in claim 41 and further comprising:

storing the score information each time a projectile passes through the target area;

calculating the total score of successive projectiles;

generating total score signals and transmitting total score signals to the display means; and displaying the total score signals with the representation of the target area.

43. The method as defined in claim 42 and further comprising:

providing shooter identification information for each of a plurality of shooters; and storing the shooter identification information for each shooter in the system and correlating the projectile location information for each shot of each shooter with the shooter information for each shooter.

44. A method of determining the location of a relatively small projectile during passage at relatively high velocity through a target area comprising:

arranging and mounting at least two transversely extending rows of light emitting devices on first and second sides of the target area so that one row of light emitting devices extends transversely to one other row of light emitting devices and arranging and mounting at least two rows of light responsive devices equal in number to the number of light emitting devices on transversely extending second and third sides of the target area so that one row of light responsive devices extends transversely relative to the other row of light responsive devices and one of the light responsive devices in each of the light responsive devices row is in coaxial alignment with one of the light emitting devices in an opposite row of light emitting devices;

generating a criss-crossing coordinated matrix of separate individual closely spaced light beams extending across the target area in substantially the same vertical plane with at least one set of closely adjacent parallel light beams extending thereacross in a first direction and at least one other set of closely adjacent parallel light beams extending thereacross in a second direction transverse to the first direction so as to provide an X-Y type coordinate light beam pattern wherein at least two of each set of light beams will be at least partially interrupted during passage of a projectile;

mounting a target sheet across the target area with target indicia on the target sheet located in predetermined relationship to the fixed X-Y coordinate pattern of light beams;

firing a projectile through the target sheet and the target area and interrupting at least two light beams in each set of X-Y coordinate light beams; and determining the location of the projectile during passage through the target sheet and the target area by measuring variations in the amount of light transmitted across the target area by each of the light beams.

45. The method as defined in claim 44 and further comprising:

displaying a replica target sheet image on a display device at a location remote from the target area;

generating shot location signals indicative of the location of the projectile during passage through the target sheet and the target area; and displaying shot location images on the replica target sheet image on the display device.

* * * * *